US008265227B2

(12) United States Patent
Boudry et al.

(10) Patent No.: US 8,265,227 B2
(45) Date of Patent: Sep. 11, 2012

(54) APPARATUS AND METHOD FOR CALIBRATING AN X-RAY TUBE

(75) Inventors: John Moore Boudry, Waukesha, WI (US); Sergio Lemaitre, Whitefish Bay, WI (US); Naveen Chandra, Kenosha, WI (US)

(73) Assignee: General Electric Company, Schenectady, NY (US)

( * ) Notice: Subject to any disclaimer, the term of this patent is extended or adjusted under 35 U.S.C. 154(b) by 485 days.

(21) Appl. No.: 12/646,320

(22) Filed: Dec. 23, 2009

(65) Prior Publication Data

US 2011/0150187 A1 Jun. 23, 2011

(51) Int. Cl.
*H05G 1/34* (2006.01)
*H05G 1/50* (2006.01)
*H05G 1/08* (2006.01)

(52) U.S. Cl. ..... 378/111; 378/110; 378/112; 378/113

(58) Field of Classification Search ..... 378/91, 378/101, 109–113, 119, 121, 134, 136–138, 378/204, 210, 901
See application file for complete search history.

(56) References Cited

U.S. PATENT DOCUMENTS

| | | | | |
|---|---|---|---|---|
| 5,033,074 | A | 7/1991 | Cotter et al. | |
| 5,233,639 | A | 8/1993 | Marks | |
| 6,438,207 | B1 | 8/2002 | Chidester et al. | |
| 6,895,079 | B2 | 5/2005 | Birdwell et al. | |
| 6,975,703 | B2 | 12/2005 | Wilson et al. | |
| 6,980,623 | B2 * | 12/2005 | Dunham et al. | 378/19 |
| 7,289,603 | B2 | 10/2007 | Andrews et al. | |
| 7,497,620 | B2 | 3/2009 | Birdwell et al. | |
| 7,507,026 | B2 | 3/2009 | Andrews et al. | |
| 2005/0175152 | A1 | 8/2005 | Smith | |
| 2009/0041198 | A1 | 2/2009 | Price et al. | |

FOREIGN PATENT DOCUMENTS

| | | | |
|---|---|---|---|
| WO | 2008017976 | A2 | 2/2008 |
| WO | 2008056299 | A1 | 5/2008 |

* cited by examiner

*Primary Examiner* — Anastasia Midkiff

(74) *Attorney, Agent, or Firm* — Ziolkowski Patent Solutions Group, SC

(57) ABSTRACT

An apparatus and method for calibrating an x-ray tube include a computer programmed to acquire a starter voltage/current value corresponding to a width, a length, or a position of a target focal spot capable of being generated by the x-ray tube. The computer is programmed to generate an electron beam and to steer the electron beam based on the starter voltage/current value. The computer is also programmed to steer the electron beam based on a value adjusted from the starter voltage/current value. The computer is programmed to calculate a final voltage/current value that is configured to generate the width, length, or position of the target focal spot based on the starter voltage/current value and the adjusted starter voltage/current value.

20 Claims, 5 Drawing Sheets

APPARATUS AND METHOD FOR CALIBRATING AN X-RAY TUBE

BACKGROUND OF THE INVENTION

The invention relates generally to diagnostic imaging and, more particularly, to an apparatus for calibrating an x-ray tube.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator.

An x-ray tube cathode provides an electron beam that is accelerated using a high voltage applied across a cathode-to-anode vacuum gap to produce x-rays upon impact with a target track of the anode. The area where the electron beam impacts the target track is often referred to as the focal spot. Typically, the cathode includes one or more cylindrical or flat resistive filaments positioned within a cup for providing electron beams to create a high-power, large focal spot or a high-resolution, small focal spot, as examples. Typically, an electrical current is passed through the resistive elements, thus causing the resistive elements to increase in temperature and emit electrons when in a vacuum.

Imaging applications may be designed that include real-time control of focal spot size (length and width) and position on the target track. The position of the focal spot may be kept at the same track location (ignoring track rotation) or dynamically deflected view-by-view between two or three or more positions. Focal spot control is enabled via electrodes surrounding the filament within the cathode structure. Changes in current (mA) and voltage (kVp) to the cathode filaments affect the position and size of the focal spot.

According to one example, to compensate for current and voltage adjustments, electrode voltages within the cathode are adjusted to achieve a desired or targeted focal spot size and position. According to another example, focal spot size and position may be controlled using magnetic lenses (dipole, quadrupole, multipole) instead of or additional to electrostatic control as described with respect to the electrode voltages. Such adjustments may occur at the start of the scan (dependent upon user selection of mA and kVp) or during an exam (e.g., mA adjustment during the exam). A mapping, referred to as a cathode transfer function, is used to determine the requisite values for the electrode voltages for a targeted focal spot size, deflection distance, kVp and mA.

Due to component manufacturing variability, a cathode transfer function is typically determined for each tube and generator combination to achieve the targeted focal spot sizes and positions (within a predetermined tolerance) for a plurality of currents and voltages. The cathode transfer function determined for a particular tube using one generator, however, may cause the tube to exceed focal spot tolerances when the particular tube is coupled to another generator. For example, a cathode transfer function determined using a generator during a manufacturing process of the x-ray tube may be different from a cathode transfer function of the same x-ray tube using a generator of an imaging system into which the x-ray tube is to be installed.

Therefore, it would be desirable to design an apparatus and method capable of determining the cathode transfer function of an x-ray tube particular to the imaging system into which the x-ray tube is to be installed.

BRIEF DESCRIPTION OF THE INVENTION

In accordance with one aspect of the invention, an apparatus includes an x-ray tube, a first generator, and a computer. The x-ray tube includes an anode, a cathode configured to emit electrons toward the anode, and a plurality of electrodes configured to steer the electrons. The first generator is coupled to the anode, to the cathode, and to the plurality of electrodes. The first generator is configured to generate a voltage differential between the cathode and the anode such that a current flows from the cathode to the anode and to supply a respective voltage to each of the plurality of electrodes to control at least one of a size and a position of a focal spot of the electrons on the anode. The computer is programmed to determine a first starter voltage value for a first set of the plurality of electrodes, the first starter voltage value comprising a pre-determined voltage value for the first set of the plurality of electrodes and corresponding to one of a width, a length, and a position of a target focal spot determined using a second generator different from the first generator. The computer is programmed to cause the first generator to generate the voltage differential between the cathode and the anode, apply a first electrode voltage to the first set of the plurality of electrodes, the first electrode voltage based on the first starter voltage value, and adjust the first electrode voltage and apply the adjusted first electrode voltage to the first set of the plurality of electrodes. The computer is also programmed to calculate a first final electrode voltage configured to generate the one of a width, a length, and a position of the target focal spot using the first final electrode voltage applied to the first set of the plurality of electrodes and using the first generator, the calculation based on the first electrode voltage and the adjusted first electrode voltage.

In accordance with another aspect of the invention, a method includes acquiring a first voltage value for a first set of electrodes of an x-ray tube, the first voltage value comprising a voltage value determined by a first generator to steer an electron beam emitting between a cathode of the x-ray tube and an anode of the x-ray tube to one of a pre-determined size and a pre-determined position such that a desired focal spot of the electron beam on the anode is created. The cathode and anode are energized via a second generator to create a voltage differential therebetween, the second generator different from the first generator, and a first electrode voltage is calculated based on the first voltage value. The method includes applying the first electrode voltage to the first set of electrodes via the second generator, calculating a second electrode voltage based on the first voltage value, and applying the second electrode voltage to the first set of electrodes via the second generator. A first final electrode voltage is calculated that is configured to generate a focal spot at the one of a pre-determined size and a pre-determined position using the first final electrode voltage applied to the first set of electrodes and using the second generator, wherein calculating comprises calculating the first final electrode voltage based on the first electrode voltage and the second electrode voltage.

In accordance with yet another aspect of the invention, a computer readable storage medium having stored thereon a computer program comprising instructions, which, when executed by a computer, cause the computer to acquire a first current value for a first set of coils of an x-ray tube, the first current value comprising a current value determined by a first generator to steer an electron beam generated via a cathode of the x-ray tube at a first voltage and at a first current to a first desired focal spot size on an anode of the x-ray tube. The instructions also cause the computer to cause a second generator to energize the cathode and anode such that the electron beam at the first voltage and at the first current is created, the second generator different from the first generator, cause the second generator to apply a first coil current to the first set of coils via the second generator, the first coil current based on the first current value, and cause acquisition of a first set of x-ray data via a detector. The second generator is caused to apply a second coil current to the first set of coils via the second generator, the second coil current based on an iterative adjustment of one of the first current value, the first coil current, and a first previous iterative adjustment coil current. The computer is further caused to cause acquisition of a second set of x-ray data via the detector and determine a third coil current based on the first and second sets of x-ray data, the third coil current configured to cause the second generator to generate the first desired focal spot size.

Various other features and advantages will be made apparent from the following detailed description and the drawings.

BRIEF DESCRIPTION OF THE DRAWINGS

The drawings illustrate one or more embodiments presently contemplated for carrying out the invention.

In the drawings.

DETAILED DESCRIPTION

Figure 1:
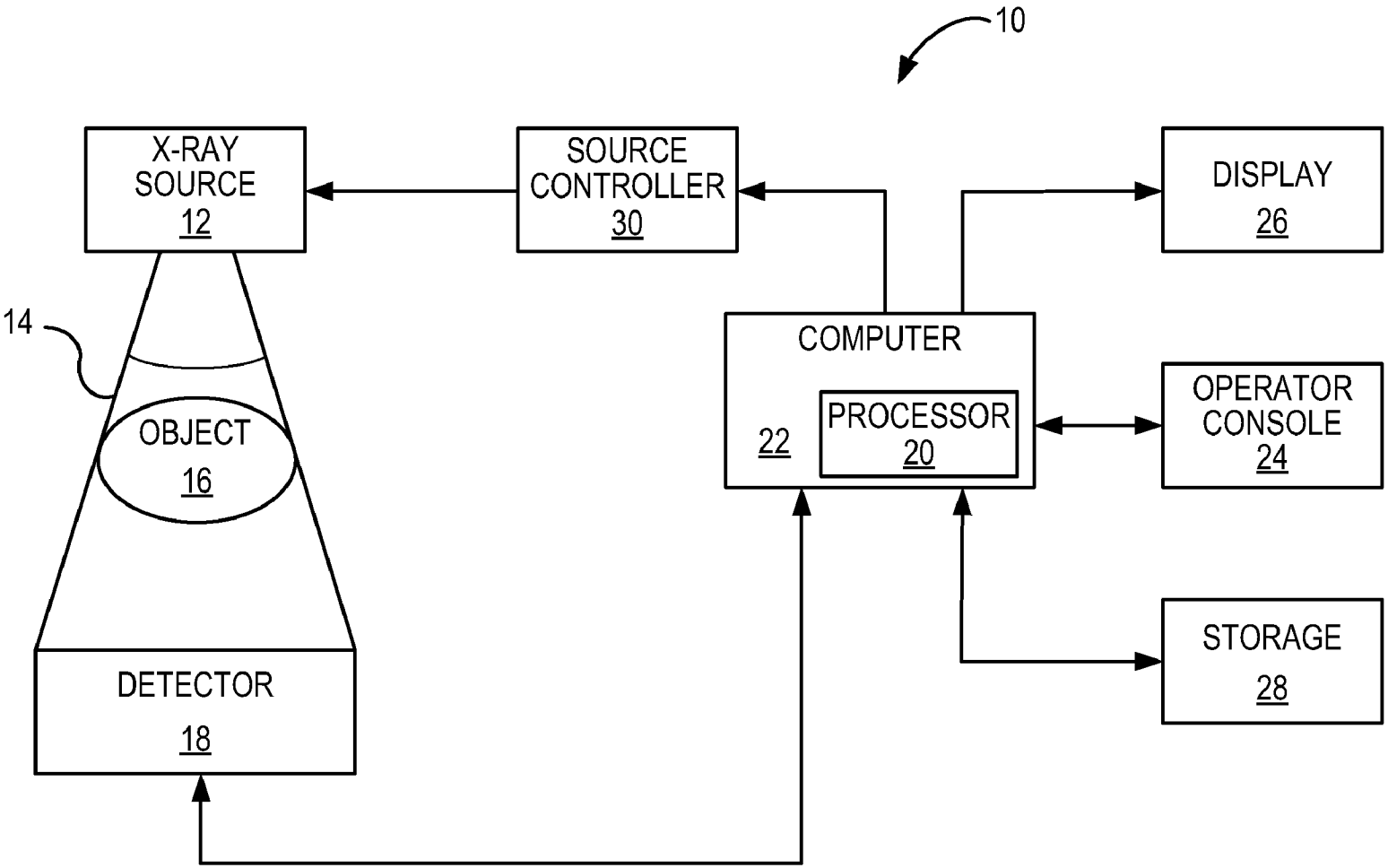
FIG. 1 is a block diagram of an imaging system according to an embodiment of the invention.

FIG. 1 is a block diagram of an embodiment of an imaging system 10 designed both to acquire original image data and to process the image data for display and/or analysis in accordance with an embodiment of the invention. It will be appreciated by those skilled in the art that the invention is applicable to numerous medical imaging systems implementing an x-ray tube, such as x-ray or mammography systems. Other imaging systems such as computed tomography systems and digital radiography systems, which acquire image three dimensional data for a volume, also benefit from an embodiment of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays pass through object 16 and, after being attenuated by the object 16, impinge upon a detector array 18. Each detector in detector array 18 produces an analog electrical signal that represents the intensity of an impinging x-ray beam, and hence the attenuated beam, as it passes through the object 16. In one embodiment, detector array 18 is a scintillation based detector, however, it is also envisioned that direct-conversion type detectors (e.g., CZT detectors, etc.) may also be implemented.

A processor 20 receives the analog electrical signals from the detector array 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
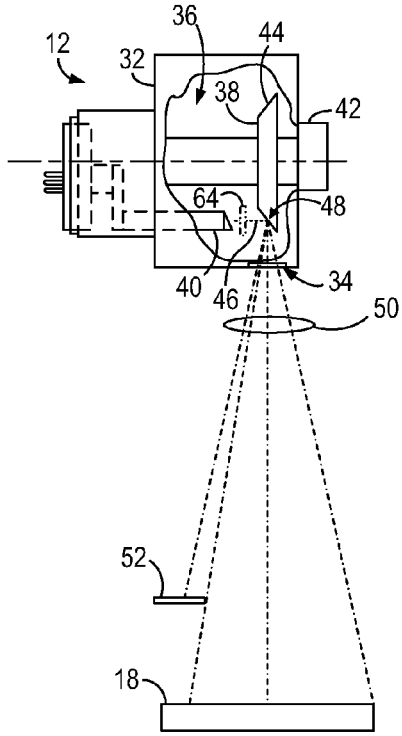
FIG. 2 is a schematic diagram of a portion of the imaging system of FIG. 1 according to an embodiment of the invention.

FIG. 2 illustrates a schematic diagram of a portion of imaging system 10 of FIG. 1 according to an embodiment of the invention. X-ray source 12 includes a vacuum chamber or frame 32 having a radiation emission passage 34 formed therein. Frame 32 encloses a vacuum 36 and houses an anode 38, a cathode 40, and a rotor 42. Anode 38 includes a target track 44.

A voltage differential or potential such as, for example, 60 thousand volts or more, between cathode 40 and anode 38 accelerates an electron beam 46 from cathode 40 to a focal spot 48 on anode 38. A stream of x-rays or x-ray beam 50 from target track 44 is produced when high-speed electrons from electron beam 46 are decelerated. X-ray beam 50 emits through radiation emission passage 34 and fan out toward detector array 18.

As shown in FIG. 2, an x-ray opaque material 52 may be positioned in the path of x-ray beam 50 for determining characteristics of focal spot 48 according to embodiments of the invention. Material 52 may be, for example, a tungsten edge or another suitable material for blocking x-rays and may be mounted to a bar (not shown) and placed within a collimator (not shown). In one embodiment, the tungsten edge is 0.1 mm thick; however, other sizes are contemplated. As will be described below, the x-ray projection of the tungsten edge upon a detector enables measurement of an edge-response function from which a size and position of the focal spot can be determined.

Figure 3:
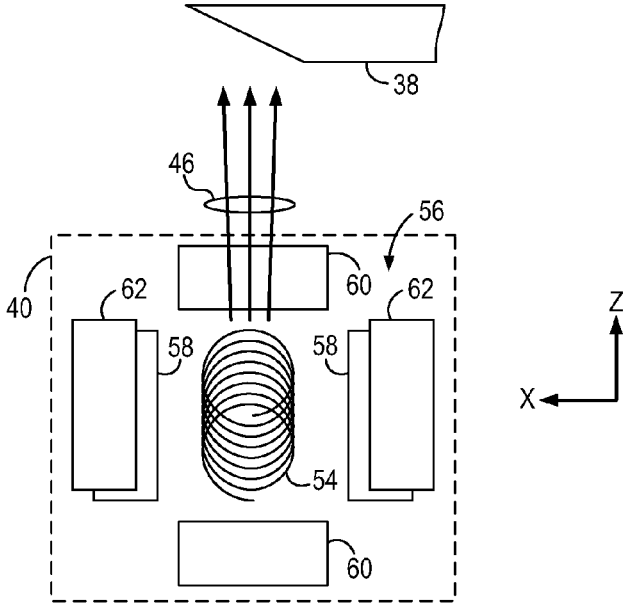
FIG. 3 is a schematic diagram of the cathode of FIG. 2 according to an embodiment of the invention.

FIG. 3 illustrates a schematic diagram of cathode 40 according to an embodiment of the invention. Referring to FIGS. 2 and 3, cathode 40 includes a filament 54 configured to emit electrons 46 when a current is passed through in a vacuum. While filament 54 is schematically shown as a circular helical coil, other configurations and shapes of filament 54 are contemplated.

A plurality of electrodes 56 is positioned about filament 54. Electrodes 56 are configured to adjust a size (both a length and a width) and a position of focal spot 48 on target track 44. Electrodes 56 include a first pair of electrodes 58 configured to adjust a focus of focal spot 48 based on a voltage, Vfocus, applied thereto. Electrodes 56 include a second pair of electrodes plurality of electrodes 60 configured to adjust a size or length of focal spot 48 in the z direction based on a voltage, Vlength, applied thereto. A third pair of electrodes 62 is included and configured to adjust a size or width of focal spot 48 in the x direction based on a voltage, Vbias, applied thereto. Electrodes 62 are also configured to adjust or steer a position of focal spot 48 on target track 44 based on a voltage, Vdefl, applied thereto. In an embodiment of the invention, a voltage is applied to electrodes 62 based on a combination of Vbias and Vdefl. For example, one of the electrodes 62 may be applied a voltage based on Vbias−Vdefl/2 while the other of the electrodes 62 may be applied a voltage based on Vbias+Vdefl/2.

Figure 4:
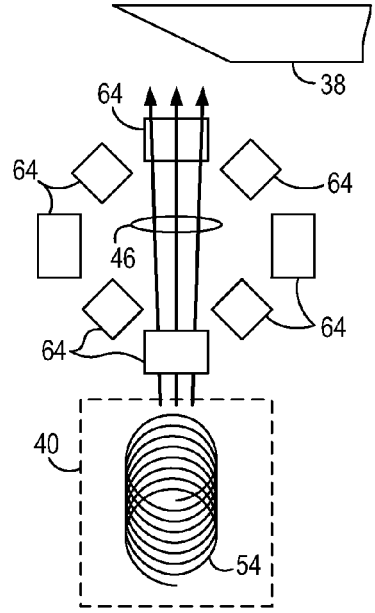
FIG. 4 is a schematic diagram of the x-ray source of FIG. 2 according to an embodiment of the invention.

FIG. 4 illustrates a schematic diagram of x-ray source 12 according to an alternate embodiment of the invention. Referring to FIGS. 2 and 4, electron beam 46 emits from filament 54 toward anode 38. Beam 46 passes through a plurality of coils 64 (shown in phantom in FIG. 2) configured to magnetically steer electron beam 46 via magnetostatic control. Coils 64 are energized via drive currents in order to produce quadrupole fields for focusing and dipole fields for deflection, respectively. The amount of current flowing through the magnet coils 64 controls the strength of the focusing/deflection action.

A cathode transfer function for cathode 40 includes a database or lookup table having electrode voltage values determined to achieve a focal spot at a target size and position for a plurality of currents and voltages to be applied to filament 54. In one embodiment, the database may include voltage values to be applied to the plurality of electrodes 56 as shown in FIG. 3 for each Vbias, Vdefl, Vfocus, and Vlength voltage parameter for each combination of filament current, filament voltage, focal spot size, and focal spot position in the database. In another embodiment, the database may include current values to be applied to the plurality of coils 64 as shown in FIG. 4 for controlling the length, width, and position of the target focal spot for each combination. For example, based on a particular current and a particular voltage to be applied to filament 54 and based on a desired target focal spot size and position, the voltage/current values for the Vbias, Vdefl, Vfocus, and Vlength electrodes may be obtained from the database. The transfer function may include electrostatic or magnetostatic control parameters C1, C2, . . . , Cn, where the control parameters C1 to Cn are functions of input parameters such as, but not limited to, kVp, mA, focal spot size, and focal spot position. As used herein, Clength, Cwidth, and Cposition refer to the electrode voltage values or to the coil current values associated with a focal spot length, width, and position parameters, respectively.

Prior to installation into a target imaging system such as during the manufacture of an x-ray-based imaging system or following a field replacement of an x-ray tube or generator, an x-ray tube may undergo a first mapping or cathode transfer function process designed to calculate the cathode transfer function for the x-ray tube. The first mapping function may be performed using a system designed to determine or calculate the cathode transfer function for a plurality of x-ray tubes using a designated test generator. Further, the cathode transfer function may be calculated for only a representative sampling of cathode filament voltage and current settings instead of a complete range of voltage and current settings. The voltages/currents calculated during the first mapping process may be referred to as starter voltages/currents. The cathode transfer function may be written to memory on the x-ray tube that may be read during a scanning procedure to determine the appropriate electrode voltage or coil current values to use. The cathode transfer function may also be written or typed out and attached to or shipped with the x-ray tube. With regard to the generator in the target imaging system, however, using the starter voltages/currents determined by the designated test generator during an imaging system scan may result in focal spot sizes and positions that exceed acceptable tolerances since the cathode transfer function depends, in part, upon the generator that the x-ray tube is coupled to.

Figure 5:
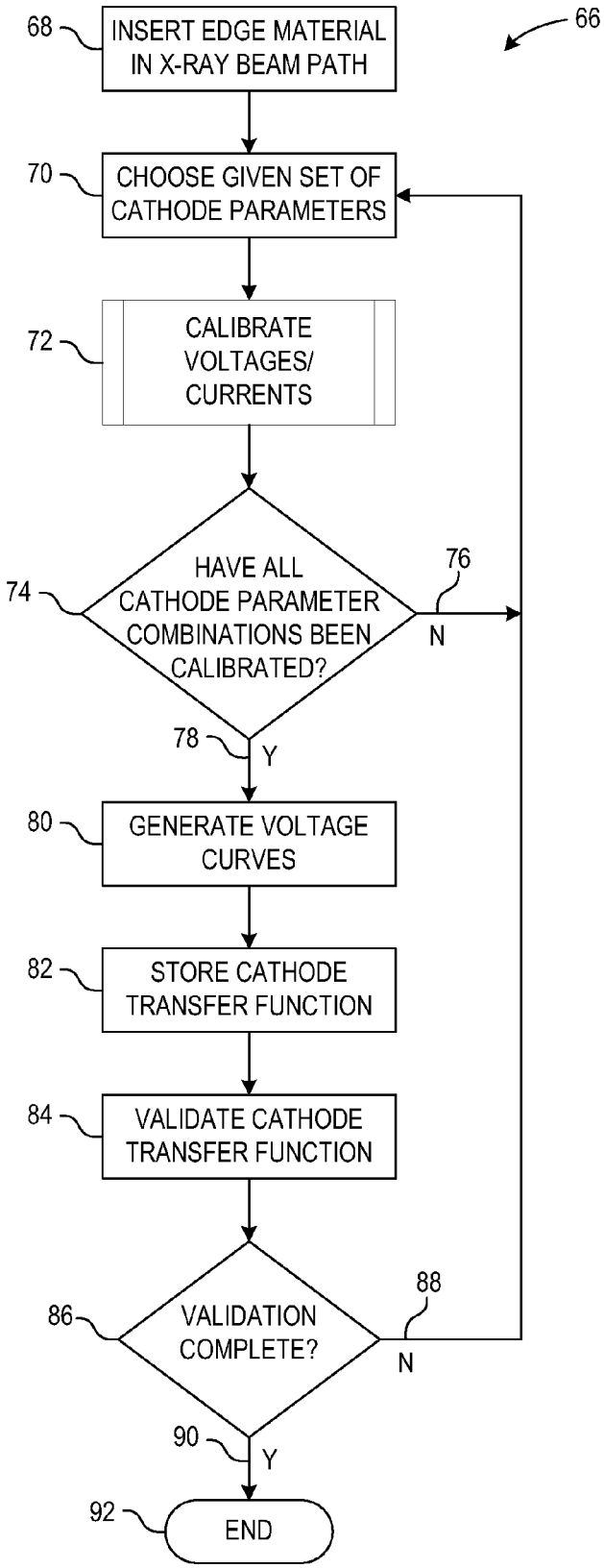
FIG. 5 is a flowchart showing a technique for calculating an x-ray tube cathode transfer function for an x-ray tube installed in an imaging system according to an embodiment of the invention.

Accordingly, FIG. 5 shows a technique 66 for calculating an x-ray tube cathode transfer function for an x-ray tube installed in an imaging system according to an embodiment of the invention. Technique 66 includes inserting an x-ray opaque edge material such as x-ray opaque material 52 of FIG. 2 in an x-ray beam path of the imaging system at block 68. At block 70, a given set of focal spot parameters is chosen to determine electrode voltages or coil currents corresponding thereto. The given set of parameters includes a target focal spot size, target focal spot position or deflection, filament current, and filament voltage. After choosing the given set of cathode parameters, a technique 72 is performed to calibrate electrode voltages or coil currents corresponding to the given set of focal spot parameters.

Figure 6:
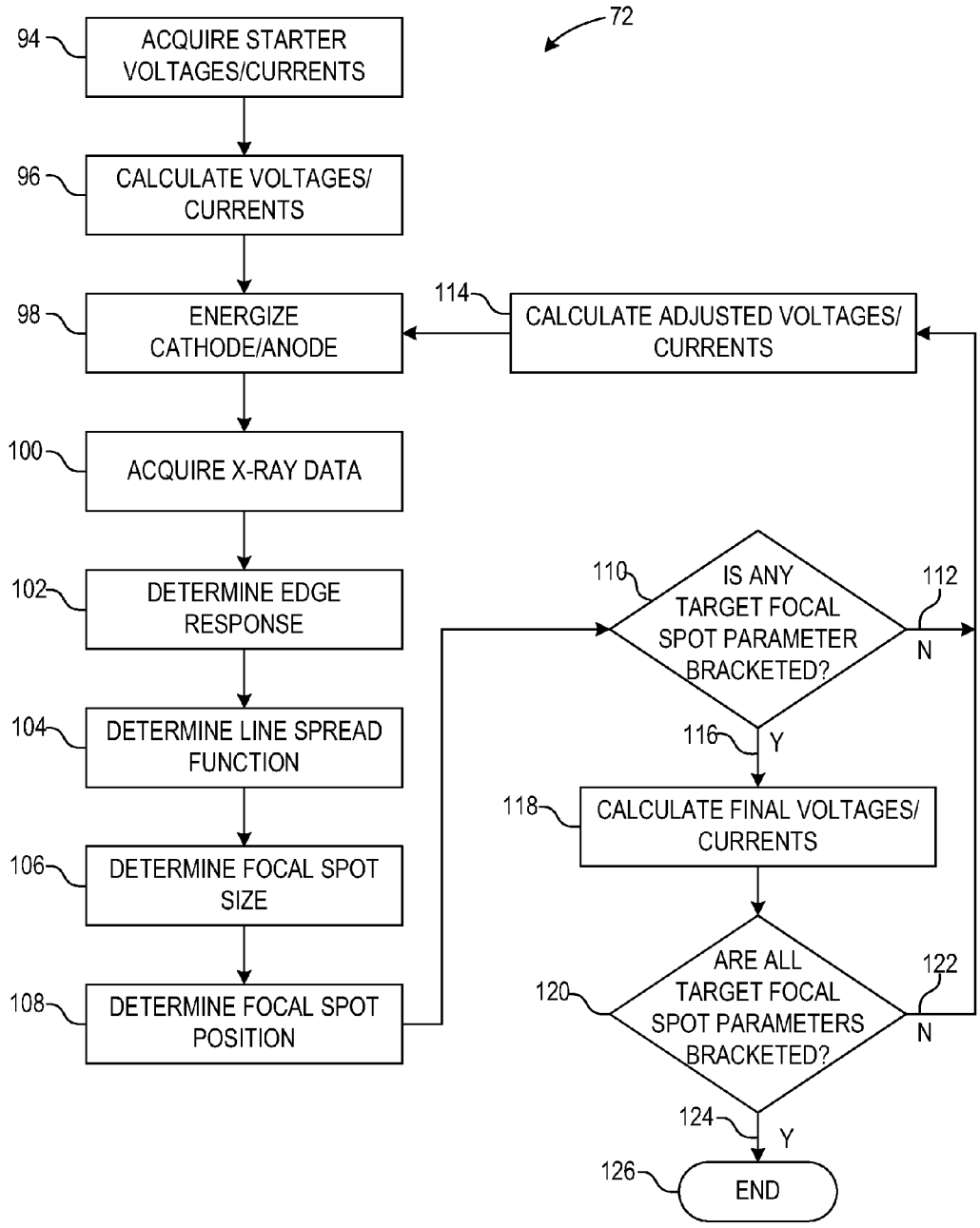
FIG. 6 is a flowchart showing a technique for determining calibration voltages for a given set of cathode parameters according to an embodiment of the invention.

Referring to FIG. 6 shows technique 72 for calibrating electrode voltages or coil currents for a given set of focal spot parameters according to an embodiment of the invention. Technique 72 includes determining or acquiring starter voltage/current values for the given focal spot size, focal spot position, filament current, and filament voltage from a predetermined cathode transfer function at block 94. The predetermined cathode transfer function represents the cathode transfer function calculated by a different generator than a generator of the imaging system into which the x-ray tube is installed as described above and may be read from a memory module coupled to the x-ray tube, for example. Alternatively, the values from the pre-determined cathode transfer function may be manually entered. If the given filament current is not in the starter voltage/current set, the starter voltages/currents may be determined through a linear interpolation of the starter voltages/currents for a filament current lower than the given filament current and the starter voltages/currents for a filament current higher than the given filament current. In one embodiment, starter voltage/current values for the Cwidth, Cposition, and Clength voltages/currents are acquired.

At block 96, electrode voltages or coil currents are calculated. In one embodiment, a voltage/current is calculated for each respective Cwidth, Clength, and Cposition voltage/current and is based on a percentage of the respective voltage/current. The electrode voltages or coil currents may be calculated based on a percentage change, such as a ten percent decrease, of the respective starter voltages/currents. For example, if a starter voltage for Cwidth is 1500 V, then the electrode voltage for Cwidth may be set to 1350 V. In another embodiment, the voltages/currents may be set to the value of the respective starter voltages/currents. While described with respect to calculating a voltage/current for all three of the Cwidth, Clength, and Cposition voltages/currents, it is contemplated that less or more than all three electrode voltages/currents may be calculated.

At block 98, the cathode and anode are energized such that an electron beam at the given filament current and given filament voltage is created. The cathode is also energized such that the electrodes corresponding to Cwidth, Clength, and Cposition receive the corresponding electrode voltages or coil currents determined at block 96 or acquired from the starter voltages/currents at block 94. X-ray data corresponding to the energized cathode are acquired at block 100.

Still referring to FIG. 6, using the acquired x-ray data, the edge response due to the edge material positioned within the x-ray beam path may be determined as an edge response function for both the channel or x direction and the slice or z direction at block 102. However, it is contemplated that the edge response function for only one of these directions may be determined according to another embodiment of the invention. The edge response function for either the x or z directions represent the intensity of the acquired x-ray data as a function of the position of the acquired data in the detector in the corresponding x or z direction.

At block 104, the derivatives of the edge response functions is determined to calculate respective line spread functions of the acquired x-ray data. The focal spot size for the respective x or z direction can be determined at block 106. In one embodiment, a modulation transfer function (MTF) corresponding to each line spread function may be determined based on a magnitude of a Fourier Transform of the respective line spread functions. Then, using the MTFs, the focal spot size may be determined via determination of frequency for an MTF intensity of 0.5, for example, in the respective MTFs. In another embodiment, a width of the line spread function may be determined. Based on the line spread function width, the width or length of the focal spot may be determined. At block 108, the position of the focal spot may be determined, in one embodiment, by determining the detector position (e.g., the detector channel for the x direction or the detector row for the z direction) for which the edge-response function is equal to the average of the maximum and minimum values. In another embodiment, the position of the focal spot may be determined by finding a peak of the line spread function.

At block 110, technique 72 determines whether the target focal spot size in the x or z direction or the target focal spot position is bracketed or bounded by any previous measures of focal spot size or position. If no target focal spot parameter is bracketed 112, such as when only one electrode focal spot size or position has been determined or when all focal spot measures are below the targeted value, technique 72 calculates adjusted electrode voltages or coil currents for all of the voltages/currents at block 114. In one embodiment, the adjusted voltages/currents may be calculated based on a percentage increase change, such as a ten percent increase, of the respective starter voltages/currents acquired at block 94. However, if multiple electrode focal spot sizes or positions have been determined and the target focal spot size or position is not bracketed, the adjusted electrode voltages or coil currents may be based on a linear interpolation of the voltages/currents previously determined and used. After calculating the adjusted electrode voltages or coil currents at block 114, technique 72 returns to block 98 to determine the size or position of the electrode focal spot using the adjusted voltages/currents. Technique 72 repeats that described for blocks 98-114 for one or multiple iterations until the target focal spot width, length, or position is bracketed by a pair of electrode voltages or coil currents in one embodiment of the of the invention.

If the target focal spot width, length, or position is bracketed by any voltages/currents 116, then a final electrode voltage or coil current corresponding to each bracketed target focal spot width, length, or position is calculated at block 118. In one embodiment, the final voltage/current is calculated using a linear interpolation of the respective voltages/currents bracketing the target focal spot width, length, or position.

Technique 72 determines at block 120 whether all of the target focal spot width, length, or position parameters have been bracketed. If at least one focal spot parameter remains unbracketed 122, then the electrode voltages or coil currents corresponding to the unbracketed target focal spot width, length, or position parameters are adjusted at block 114 as described above. Then, any calculated final voltages/currents at block 118 are used for the respective cathode electrode voltage or coil current at block 98 while the iteration loop 98-114 is performed for the remaining unbracketed values. When all target focal spot size and position parameters have been bracketed 124, technique 72 ends 126.

Referring again to FIG. 5, after the voltages/currents have been determined at block 72, technique 66 determines whether all desired cathode parameter combinations have been calibrated at block 74. If not 76, technique 66 returns to block 70 where a different given set of focal spot parameters are chosen for a different cathode parameter combination. For example, for each target focal spot size, target focal spot position, and filament voltage combination, two or more filament current values may be combined therewith to calculate respective electrode voltages or coil currents. Accordingly, at block 70 the given target focal spot size, target focal spot position, and filament voltage values may remain unchanged while the filament current value may change. However, one or all of the given set of electrode parameters may change.

In one embodiment of the invention, the x-ray tube may be used in a fast-kVp switching sequence in which the filament voltage is switched from view-to-view while the filament current remains the same. In another embodiment, the filament current may be switched instead of or in addition to the filament voltage switching. In these types of fast-kVp switching, the focal spot is not deflected, but the width of the focal spot is affected by the voltage/current changes. To counteract width changes to the focal spot, the Cwidth values are switched from view-to-view to maintain the focal spot width value for each of the two fast-kVp switching values. Accordingly, embodiments of the invention include calculation of the electrode voltages for the desired cathode parameter combinations includes determining the Cwidth values at different filament voltage values for each target focal spot size, target focal spot position, and filament current combination such that the target focal spot size between the view-to-view filament voltage changes is maintained. Embodiments of the invention also include calculating coil currents for different filament current values for each target focal spot size, target focal spot position, and filament voltage combination such that the target focal spot size between the view-to-view filament current changes is maintained.

If all cathode parameter combinations have been calibrated 78, the electrode calibration is completed, and linear or polynomial curves may be generated at block 80 for the Cwidth, Clength, and Cposition voltages/currents for each target focal spot size and position combination. For example, for a given target focal spot size and position and for a given filament voltage, a curve for the Clength voltages/currents as a function of the filament current may be determined using a linear curve for two Clength voltages/currents or a polynomial curve for three or more Clength voltages/currents. Corresponding curves for Cwidth and Cposition may also be generated as well as curves for other filament voltages for the given target focal spot size and position.

In an embodiment of the invention, the cathode transfer function is stored at block 82. The curves generated at block 80 may be stored, or the electrode values calibrated during the electrode process at block 72 may be stored. In one embodiment, the cathode transfer function is stored to the x-ray tube memory and may overwrite the cathode transfer function determined by the test generator. In another embodiment, the cathode transfer function is written to a different computer readable storage medium capable of recalling the values during a subsequent imaging sequence.

In an embodiment of the invention, the cathode transfer function is validated at block 84. During the validation, all or a sampling of the cathode voltage or coil current values determined during the electrode process are tested to validate whether the target focal spot parameters corresponding to those voltages/currents are measured to be within a specified value or threshold of the expected parameters. At block 86, technique 66 determines whether the validation is complete. If not 88, the electrode process is repeated. If so 90, then technique 66 ends 92.

For techniques 66, 72, it may be assumed in one embodiment that the focal spot parameters behave in an orthogonal manner. That is, changes in Vdefl are assumed to only affect focal spot position deflection, changes in Vlength to only affect focal spot length, and changes in Cwidth to only affect focal spot width.

In addition, a number of constraints may be enforced by technique 72. A first constraint is that the iterative process stops after a maximum number of iterations if any of the focal spot parameters have not been bracketed. This first constraint, for example, handles the phenomenon of overfocussing whereby an increase in the electrode voltage or coil current causes a decrease in the resulting MTF frequency. If the maximum number of iterations is reached, the voltage/current for which the measure is closest to the targeted value is used. A second constraint that may be enforced is that the iterative process ensures that cathode minimum and maximum voltage/currents limits are not exceeded. The second constraint helps to avoid shortening the life of the cathode. A third constraint that may be enforced is that the electrode focal spot parameter values be within a percentage of their respective target values. The third constraint helps to reduce the number of iterations and decrease electrode time. A fourth constraint that may be enforced is that if an additional iteration is performed for a particular cathode electrode voltage or coil current, limits to the maximum change in this voltage/current value (relative to values in the previous iteration) are applied. The fourth constraint helps to prevent large changes in cathode voltages or coil currents and associated erratic behavior.

Figure 7:
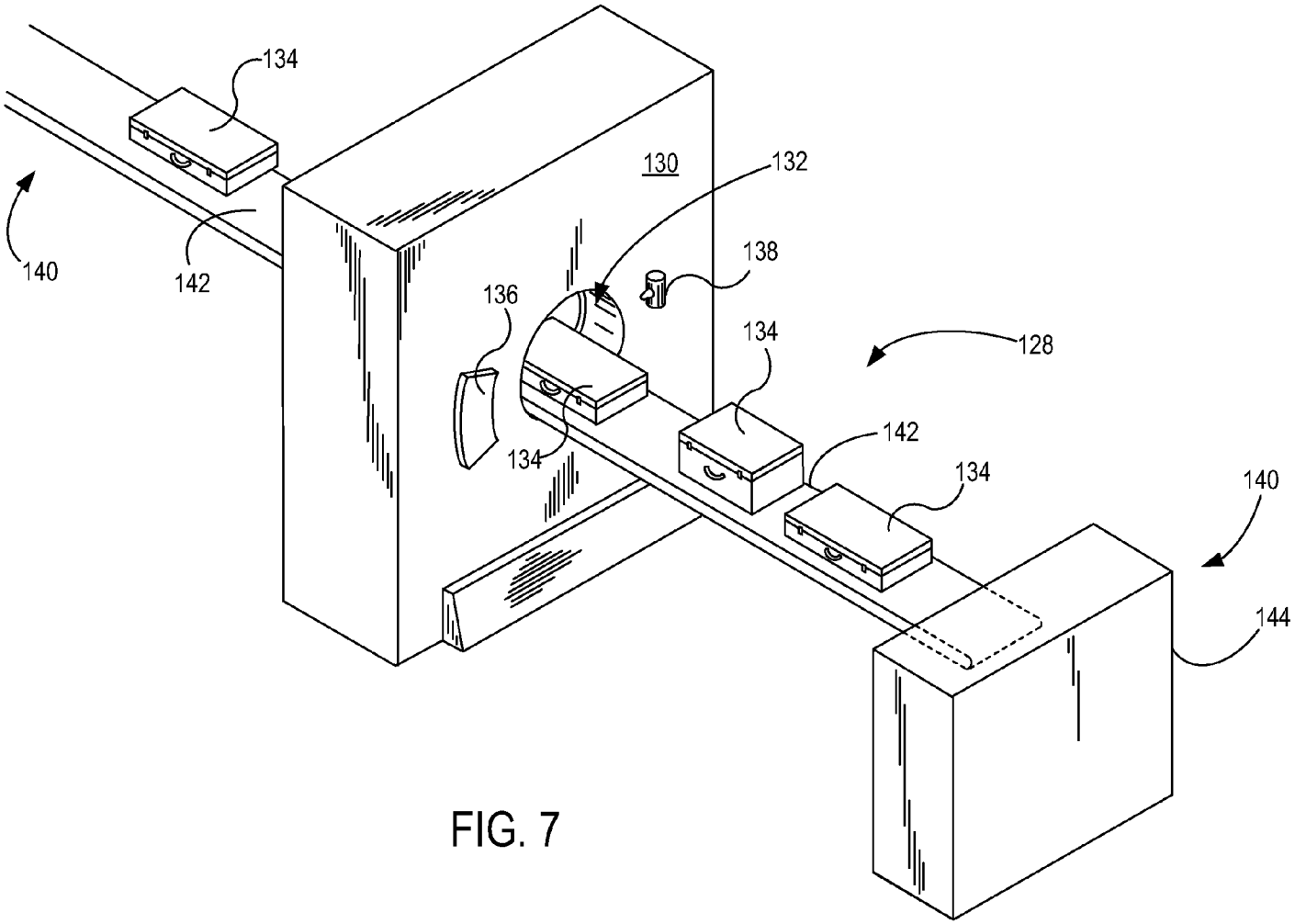
FIG. 7 is a pictorial view of an x-ray system for use with a non-invasive package inspection system that can benefit from incorporation of an embodiment of the invention.

FIG. 7 is a pictorial view of an x-ray imaging system 128 for use with a non-invasive package inspection system. The x-ray system includes 128 a gantry 130 having an opening 132 therein through which a plurality of packages or pieces of baggage 134 may pass. The gantry 130 houses a detector assembly 136 and a high frequency electromagnetic energy source, such as an x-ray tube 138. A conveyor system 140 is also provided and includes a conveyor belt 142 supported by a structure 144 to automatically and continuously pass packages or baggage pieces 134 through opening 132 to be scanned. Objects 134 are fed through opening 132 by conveyor belt 142, imaging data is then acquired, and the conveyor belt 142 removes the packages 134 from opening 132 in a controlled and continuous manner. As a result, postal inspectors, baggage handlers, and other security personnel may non-invasively inspect the contents of packages 134 for explosives, knives, guns, contraband, etc. One skilled in the art will recognize that gantry 130 may be stationary or rotatable. In the case of a rotatable gantry 130, system 128 may be configured to operate as a CT system for baggage scanning or other industrial or medical applications.

With respect to FIGS. 1 and 7, one skilled in the art will appreciate that system 10 of FIG. 1 and/or system 128 of FIG. 7 includes a plurality of components such as one or more of electronic components, hardware components, and/or computer software components. These components may include one or more tangible computer readable storage media that generally stores instructions such as software, firmware and/or assembly language for performing one or more portions of one or more implementations or embodiments such as techniques 66, 72 of FIGS. 4 and 5, respectively. Examples of a tangible computer readable storage medium include a recordable data storage medium of the computer 22 and/or storage device 28. Such tangible computer readable storage medium may employ, for example, one or more of a magnetic, electrical, optical, biological, and/or atomic data storage medium. Further, such media may take the form of, for example, floppy disks, magnetic tapes, CD-ROMs, DVD-ROMs, hard disk drives, and/or electronic memory. Other forms of tangible computer readable storage media not list may be employed with embodiments of the invention.

A number of such components can be combined or divided in an implementation of the system 10 and/or 128. Further, such components may include a set and/or series of computer instructions written in or implemented with any of a number of programming languages, as will be appreciated by those skilled in the art.

A technical contribution for the disclosed apparatus and method is that it provides for a computer implemented x-ray tube calibration.

Therefore, in accordance with one embodiment of the invention, an apparatus includes an x-ray tube, a first generator, and a computer. The x-ray tube includes an anode, a cathode configured to emit electrons toward the anode, and a plurality of electrodes configured to steer the electrons. The first generator is coupled to the anode, to the cathode, and to the plurality of electrodes. The first generator is configured to generate a voltage differential between the cathode and the anode such that a current flows from the cathode to the anode and to supply a respective voltage to each of the plurality of electrodes to control at least one of a size and a position of a focal spot of the electrons on the anode. The computer is programmed to determine a first starter voltage value for a first set of the plurality of electrodes, the first starter voltage value comprising a pre-determined voltage value for the first set of the plurality of electrodes and corresponding to one of a width, a length, and a position of a target focal spot determined using a second generator different from the first generator. The computer is programmed to cause the first generator to generate the voltage differential between the cathode and the anode, apply a first electrode voltage to the first set of the plurality of electrodes, the first electrode voltage based on the first starter voltage value, and adjust the first electrode voltage and apply the adjusted first electrode voltage to the first set of the plurality of electrodes. The computer is also programmed to calculate a first final electrode voltage configured to generate the one of a width, a length, and a position of the target focal spot using the first final electrode voltage applied to the first set of the plurality of electrodes and using the first generator, the calculation based on the first electrode voltage and the adjusted first electrode voltage.

In accordance with another embodiment of the invention, a method includes acquiring a first voltage value for a first set of electrodes of an x-ray tube, the first voltage value comprising a voltage value determined by a first generator to steer an electron beam emitting between a cathode of the x-ray tube and an anode of the x-ray tube to one of a pre-determined size and a pre-determined position such that a desired focal spot of the electron beam on the anode is created. The cathode and anode are energized via a second generator to create a voltage differential therebetween, the second generator different from the first generator, and a first electrode voltage is calculated based on the first voltage value. The method includes applying the first electrode voltage to the first set of electrodes via the second generator, calculating a second electrode voltage based on the first voltage value, and applying the second electrode voltage to the first set of electrodes via the second generator. A first final electrode voltage is calculated that is configured to generate a focal spot at the one of a pre-determined size and a pre-determined position using the first final electrode voltage applied to the first set of electrodes and using the second generator, wherein calculating comprises calculating the first final electrode voltage based on the first electrode voltage and the second electrode voltage.

In accordance with yet another embodiment of the invention, a computer readable storage medium having stored thereon a computer program comprising instructions, which, when executed by a computer, cause the computer to acquire a first current value for a first set of coils of an x-ray tube, the first current value comprising a current value determined by a first generator to steer an electron beam generated via a cathode of the x-ray tube at a first voltage and at a first current to a first desired focal spot size on an anode of the x-ray tube. The instructions also cause the computer to cause a second generator to energize the cathode and anode such that the electron beam at the first voltage and at the first current is created, the second generator different from the first generator, cause the second generator to apply a first coil current to the first set of coils via the second generator, the first coil current based on the first current value, and cause acquisition of a first set of x-ray data via a detector. The second generator is caused to apply a second coil current to the first set of coils via the second generator, the second coil current based on an iterative adjustment of one of the first current value, the first coil current, and a first previous iterative adjustment coil current. The computer is further caused to cause acquisition of a second set of x-ray data via the detector and determine a third coil current based on the first and second sets of x-ray data, the third coil current configured to cause the second generator to generate the first desired focal spot size.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus comprising:

an x-ray tube comprising:

an anode;

a cathode configured to emit electrons toward the anode; and a plurality of electrodes configured to steer the electrons;

a first generator coupled to the anode, to the cathode, and to the plurality of electrodes, the first generator configured to:

generate a voltage differential between the cathode and the anode such that a current flows from the cathode to the anode; and supply a respective voltage to each of the plurality of electrodes to control at least one of a size and a position of a focal spot of the electrons on the anode; and a computer programmed to:

determine a first starter voltage value for a first set of the plurality of electrodes, the first starter voltage value comprising a pre-determined voltage value for the first set of the plurality of electrodes and corresponding to one of a width, a length, and a position of a target focal spot determined using a second generator different from the first generator;

cause the first generator to generate the voltage differential between the cathode and the anode;

apply a first electrode voltage to the first set of the plurality of electrodes, the first electrode voltage based on the first starter voltage value;

adjust the first electrode voltage and apply the adjusted first electrode voltage to the first set of the plurality of electrodes; and calculate a first final electrode voltage configured to generate the one of a width, a length, and a position of the target focal spot using the first final electrode voltage applied to the first set of the plurality of electrodes and using the first generator, the calculation based on the first electrode voltage and the adjusted first electrode voltage.

2. The apparatus of claim 1 further comprising:

a detector configured to receive x-rays generated from the anode;

an x-ray opaque edge positioned between the detector and the x-ray tube; and wherein the computer is further programmed to:

acquire a first set of x-ray data corresponding to the first electrode voltage via the detector;

acquire a second set of x-ray data corresponding to the adjusted first electrode voltage via the detector; and calculate the first final electrode voltage using data based on the acquired first set of x-ray data and using data based on the acquired second set of x-ray data.

3. The apparatus of claim 2 wherein the x-ray opaque edge comprises a tungsten edge.

4. The apparatus of claim 2 wherein the computer is further programmed to:

determine a first value of a first focal spot using data based on the acquired first set of x-ray data, the first focal spot corresponding to the first electrode voltage, and the first value of the first focal spot corresponding to one of a width, a length, and a position of the first focal spot; and determine a first value of a second focal spot using data based on the acquired second set of x-ray data, the second focal spot corresponding to the adjusted first electrode voltage, and the first value of the second focal spot corresponding to one of a width, a length, and a position of the second focal spot.

5. The apparatus of claim 4 wherein the computer is further programmed to:

determine a first edge response function in a first direction from the acquired first set of x-ray data; and determine a second edge response function in the first direction from the acquired second set of x-ray data.

6. The apparatus of claim 5 wherein the computer is further programmed to:

calculate a first modulation transfer function (MTF) based on the first edge response function; and calculate a second MTF based on the second edge response function.

7. The apparatus of claim 6 wherein the computer, in being programmed to determine the first value of the first focal spot, is configured to determine the first value of the first focal spot using the first MTF; and wherein the computer, in being programmed to determine the first value of the second focal spot, is configured to determine the first value of the second focal spot using the second MTF.

8. The apparatus of claim 6 wherein the computer is further programmed to:

determine if one of a width, a length, and a position of the target focal spot is bounded by the first value of the first focal spot and the first value of the second focal spot; and calculate the first final electrode voltage configured to generate the one of a width, a length, and a position of the target focal spot size based on the first MTF and the second MTF if the one of a width, a length, and a position of the target focal spot size is bounded by the first value of the first focal spot and the first value of the second focal spot.

9. The apparatus of claim 8 wherein the computer is further programmed to iteratively adjust the first electrode voltage until application of the iteratively adjusted first electrode voltage to the first set of the plurality of electrodes causes the one of a width, a length, and a position of the target focal spot to be bounded by the first value of the first focal spot and the first value of the second focal spot.

10. The apparatus of claim 8 wherein the computer, in being programmed to calculate the first final electrode voltage, is configured to calculate the first final electrode voltage based on a linear interpolation of the first MTF and the second MTF 11. The apparatus of claim 8 wherein the computer is further programmed to:

determine a second starter voltage value for a second set of the plurality of electrodes, the second starter voltage value comprising a pre-determined voltage value the second set of the plurality of electrodes and corresponding to one of a size and a position of the target focal spot determined using the second generator;

apply a second electrode voltage to the second set of the plurality of electrodes, the second electrode voltage different from the first electrode voltage and based on the second starter voltage value;

adjust the second electrode voltage and apply the adjusted second electrode voltage to the second set of the plurality of electrodes;

acquire a third set of x-ray data corresponding to the second electrode voltage via the detector;

acquire a fourth set of x-ray data corresponding to the adjusted second electrode voltage via the detector;

determine a third edge response function in a second direction from the acquired third set of x-ray data, the second direction perpendicular to the first direction;

determine a fourth edge response function in the second direction from the acquired fourth set of x-ray data;

calculate a third MTF based on the third edge response function;

calculate a fourth MTF based on the fourth edge response function;

determine a second value of the first focal spot using the third MTF, wherein the second value of the first focal spot corresponds to one of a width, a length, and a position of the first focal spot different from the first value of the first focal spot;

determine a second value of a second focal spot using the fourth MTF, wherein the second value of the second focal spot corresponds to one of a width, a length, and a position of the second focal spot different from the first value of the second focal spot;

determine if the one of a width, a length, and a position of the target focal spot size is bounded by the second value of the first focal spot and the second value of the second focal spot; and calculate a second final electrode voltage configured to generate the one of a width, a length, and a position of the target focal spot based on the third MTF and the fourth MTF if the one of a width, a length, and a position of the target focal spot size is bounded by the second value of the first focal spot and the second value of the second focal spot.

12. A method comprising:

acquiring a first voltage value for a first set of electrodes of an x-ray tube, the first voltage value comprising a voltage value determined by a first generator to steer an electron beam emitting between a cathode of the x-ray tube and an anode of the x-ray tube to one of a pre-determined size and a pre-determined position such that a desired focal spot of the electron beam on the anode is created;

energizing the cathode and anode via a second generator to create a voltage differential therebetween, the second generator different from the first generator;

calculating a first electrode voltage based on the first voltage value;

applying the first electrode voltage to the first set of electrodes via the second generator;

calculating a second electrode voltage based on the first voltage value;

applying the second electrode voltage to the first set of electrodes via the second generator; and calculating a first final electrode voltage configured to generate a focal spot at the one of a pre-determined size and a pre-determined position using the first final electrode voltage applied to the first set of electrodes and using the second generator, wherein calculating comprises calculating the first final electrode voltage based on the first electrode voltage and the second electrode voltage.

13. The method of claim 12 further comprising:

acquiring a first set of x-ray data via a detector, the first set of x-ray data corresponding to a first x-ray beam generated via application of the first electrode voltage to the first set of electrodes and corresponding to a material positioned to absorb a portion of the first x-ray beam; and acquiring a second set of x-ray data via the detector, the second set of x-ray data corresponding to a second x-ray beam generated via application of the second electrode voltage to the first set of electrodes and corresponding to the material positioned to absorb a portion of the second x-ray beam.

14. The method of claim 13 wherein the material comprises tungsten.

15. The method of claim 13 further comprising:

determining a first edge response function from the acquired first set of x-ray data;

calculating a first width of a portion of the first edge response function;

determining a second edge response function from the acquired second set of x-ray data; and calculating a second width of a portion of the second edge response function.

16. The method of claim 15 wherein calculating the first final electrode voltage comprises calculating the first final electrode voltage based on a linear interpolation of the first and second widths if the first and second widths bracket a target frequency value.

17. A computer readable storage medium having stored thereon a computer program comprising instructions, which, when executed by a computer, cause the computer to:

acquire a first current value for a first set of coils of an x-ray tube, the first current value comprising a current value determined by a first generator to steer an electron beam generated via a cathode of the x-ray tube at a first voltage and at a first current to a first desired focal spot size on an anode of the x-ray tube;

cause a second generator to energize the cathode and anode such that the electron beam at the first voltage and at the first current is created, the second generator different from the first generator;

cause the second generator to apply a first coil current to the first set of coils via the second generator, the first coil current based on the first current value;

cause acquisition of a first set of x-ray data via a detector;

cause the second generator to apply a second coil current to the first set of coils via the second generator, the second coil current based on an iterative adjustment of one of the first current value, the first coil current, and a first previous iterative adjustment coil current;

cause acquisition of a second set of x-ray data via the detector; and determine a third coil current based on the first and second sets of x-ray data, the third coil current configured to cause the second generator to generate the first desired focal spot size.

18. The computer readable storage medium of claim 17 wherein the instructions further cause the computer to:

determine a first edge response function from the first set of x-ray data;

calculate one of a width and a length of the first desired focal spot based on the first edge response function;

determine a second edge response function from the second set of x-ray data;

calculate the one of a width and a length of the first desired focal spot based on the second edge response function.

19. The computer readable storage medium of claim 18 wherein the instructions further cause the computer to:

acquire a second current value for a second set of coils of an x-ray tube, the second current value comprising a current value determined by the first generator to steer an electron beam generated via the cathode at the first voltage and at a second current to a second desired focal spot size on the anode;

cause the second generator to energize the cathode and anode such that the electron beam at the first voltage and at the second current is created, the second generator different from the first generator;

cause the second generator to apply a fourth coil current to the first set of coils via the second generator, the fourth coil current based on the second current value;

cause acquisition of a third set of x-ray data via the detector;

cause the second generator to apply a fifth coil current to the first set of coils via the second generator, the fifth coil current based on an iterative adjustment of one of the second current value, the fourth coil current, and a second previous iterative adjustment coil current;

cause acquisition of a fourth set of x-ray data via the detector; and determine a third edge response function from the third set of x-ray data;

calculate one of a width and a length of the second desired focal spot based on the third edge response function;

determine a fourth edge response function from the fourth set of x-ray data;

calculate the one of a width and a length of the second desired focal spot based on the fourth edge response function;

determine a sixth coil current based on the third and fourth sets of x-ray data, the sixth coil current configured to cause the second generator to generate the second desired focal spot size.

20. The computer readable storage medium of claim 19 wherein the instructions further cause the computer to determine a curve of coil currents for a given electron beam voltage at a given target focal spot size and position based on the third and sixth coil voltages and based on the first and second current values.

* * * * *